US010253773B2

(12) United States Patent
Higashiyama et al.

(10) Patent No.: US 10,253,773 B2
(45) Date of Patent: Apr. 9, 2019

(54) ATTACHMENT STRUCTURE FOR COMPRESSOR

(71) Applicant: DENSO CORPORATION, Kariya, Aichi-pref. (JP)

(72) Inventors: Masashi Higashiyama, Kariya (JP); Masami Sanuki, Kariya (JP); Tsuyoshi Takemoto, Kariya (JP); Shigeru Kawano, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 286 days.

(21) Appl. No.: 15/108,802

(22) PCT Filed: Jan. 21, 2015

(86) PCT No.: PCT/JP2015/000255
§ 371 (c)(1),
(2) Date: Jun. 29, 2016

(87) PCT Pub. No.: WO2015/115062
PCT Pub. Date: Aug. 6, 2015

(65) Prior Publication Data

US 2016/0327039 A1 Nov. 10, 2016

(30) Foreign Application Priority Data

Jan. 29, 2014 (JP) ..... 2014-014098

(51) Int. Cl.
*F01C 21/10* (2006.01)
*F01C 21/00* (2006.01)
(Continued)

(52) U.S. Cl.
CPC ..... *F04C 18/0215* (2013.01); *F01C 21/007* (2013.01); *F01C 21/10* (2013.01);
(Continued)

(58) Field of Classification Search
CPC ..... F01C 1/02; F01C 1/0207; F01C 1/0215; F01C 1/0223; F01C 19/08; F01C 21/007;
(Continued)

(56) References Cited

U.S. PATENT DOCUMENTS 3,884,599 A * 5/1975 Young ..... F01C 1/0215 418/188
5,513,967 A * 5/1996 Nakamoto ..... F04C 18/0269 418/1

(Continued)

FOREIGN PATENT DOCUMENTS

JP 2008138685 A 6/2008

*Primary Examiner* — Essama Omgba
*Assistant Examiner* — Thomas Manley
(74) *Attorney, Agent, or Firm* — Harness, Dickey & Pierce, P.L.C.

(57) ABSTRACT

An attachment structure is for attaching a compressor to an attachment surface of an attachment target member. The compressor is a scroll type compressor and has a housing, a fixed scroll and a movable scroll. The housing is fixed to the attachment surface. The fixed scroll is fixed inside the housing and has a fixed-side tooth having a scroll shape. The movable scroll has a movable-side tooth having a scroll shape and engaging with the fixed-side tooth. The movable scroll revolves with respect to the fixed scroll. A central axis around which the movable scroll revolves is parallel with the attachment surface. A vibration direction, which is included in a radial direction of the compressor and in which a vibration component becomes largest, is different from a normal direction when viewed in an axial direction of the central axis.

3 Claims, 5 Drawing Sheets

(51) Int. Cl.

| | |
|---|---|
| ***F04C 18/02*** | (2006.01) |
| ***F04C 23/00*** | (2006.01) |
| ***F04C 25/00*** | (2006.01) |
| ***F04C 27/00*** | (2006.01) |
| *F04C 29/00* | (2006.01) |

(52) U.S. Cl.
CPC ..... *F04C 23/008* (2013.01); *F04C 25/00* (2013.01); *F04C 27/003* (2013.01); *F04C 29/0085* (2013.01); *F04C 2210/26* (2013.01); *F04C 2230/604* (2013.01); *F04C 2240/30* (2013.01); *F04C 2240/40* (2013.01); *F04C 2270/12* (2013.01)

(58) Field of Classification Search
CPC ..... F01C 21/10; F04C 18/02; F04C 18/0207; F04C 18/0215; F04C 18/0223; F04C 18/0261; F04C 18/0292; F04C 23/008; F04C 27/005; F04C 29/042; F04C 29/124; F04C 29/126; F04C 29/128; F04C 2210/26; F04C 2230/60; F04C 2230/604; F04C 2240/30; F04C 2240/40; F04C 2270/12
USPC ..... 417/410.5, 423.14, 360; 418/55.1–55.5
See application file for complete search history.

(56) References Cited

U.S. PATENT DOCUMENTS

| | | | | |
|---|---|---|---|---|
| 6,120,269 | A * | 9/2000 | Iizuka | F01C 17/066 418/1 |
| 6,217,297 | B1 * | 4/2001 | Tsumagari | B60H 1/00514 417/360 |
| 6,669,452 | B2 * | 12/2003 | Ogawa | B60K 6/22 417/360 |
| 2012/0128518 | A1 * | 5/2012 | Yamada | F04C 18/0215 418/55.6 |
| 2012/0288394 | A1 * | 11/2012 | Murakami | F04C 18/0269 418/55.1 |
| 2013/0017100 | A1 * | 1/2013 | Ota | F01C 21/10 417/321 |
| 2013/0121865 | A1 * | 5/2013 | Jang | F04C 18/00 418/55.1 |
| 2013/0251557 | A1 * | 9/2013 | Ota | F04B 17/03 417/410.1 |

* cited by examiner

ATTACHMENT STRUCTURE FOR COMPRESSOR

CROSS REFERENCE TO RELATED APPLICATIONS

This application is a U.S. National Phase Application under 35 U.S.C. 371 of International Application No. PCT/JP2015/000255 filed on Jan. 21, 2015 and published in Japanese as WO 2015/115062 A1 on Aug. 6, 2015. This application is based on and claims the benefit of priority from Japanese Patent Application No. 2014-014098 filed on Jan. 29, 2014. The entire disclosures of all of the above applications are incorporated herein by reference.

TECHNICAL FIELD

The present disclosure relates to an attachment structure for a compressor employed to attach the compressor to an attachment target member.

BACKGROUND ART

Conventionally, an attachment structure for an electric compressor is disclosed in Patent Literature 1. The attachment structure is used to attach an electric compressor, which compresses a refrigerant and discharges the refrigerant in a refrigeration cycle device, to an internal combustion engine (i.e., an engine) that outputs driving force for traveling a vehicle in a hybrid vehicle.

According to the attachment structure for an electric compressor of Patent Literature 1, an electric motor of the electric compressor is located on a barycenter side of the engine than a compression mechanism part, and a crank shaft of the engine and a central axis of the electric compressor are parallel with each other. Thus, an excitation force applied to the electric motor from the engine may be suppressed.

PRIOR ART LITERATURES

Patent Literature

Patent Literature 1: JP 2008-138685 A

SUMMARY OF INVENTION

However, according to studies by inventors of the present disclosure, a vibration component that makes an attachment surface easily generate noise is a vibration component in a direction perpendicular to the attachment surface, relating to a vibration of the attachment surface of an attachment target member to which the compressor is attached. Moreover, vibration components in a radial direction may not be even in the compressor when viewed in an axial direction of a rotational center axis, and the vibration components in the radial direction may easily have distribution.

For example, in a case where a compressor is attached to an engine for a hybrid vehicle as in Patent Literature 1, a vibration of the compressor is transmitted to the attachment surface of the engine to which the compressor is attached when the compressor is operated, for example, while the engine is being stopped. In this instance, the attachment surface of the engine to which the compressor is attached may function as a diaphragm, and it may result in an occurrence of large noise.

The present disclosure addresses the above-described issue, and it is an objective of the present disclosure to provide an attachment structure for a compressor with which an occurrence of noise occurred by a vibration of an attachment surface of an attachment target member can be suppressed.

According to a first aspect of the present disclosure, a compressor, which compresses a fluid and discharged the fluid, is attached to an attachment surface of an attachment target member by an attachment structure for a compressor.

The compressor is a scroll type compressor and has a housing that is fixed to the attachment surface, a fixed scroll that is fixed inside the housing and has a fixed-side tooth having a scroll shape, and a movable scroll that has a movable-side tooth having a scroll shape and engaging with the fixed-side tooth and revolves with respect to the fixed scroll. A central axis around which the movable scroll revolves is parallel with the attachment surface. A vibration direction, which is in the radial direction of the compressor, in which a vibration component becomes largest is different from a normal direction when viewed in an axial direction of the central axis.

In the scroll type compressor used as a compressor, vibration components in a radial direction may easily have distribution. Then, according to the attachment structure for a compressor of the first aspect of the present disclosure, the vibration direction, which is in the radial direction of the compressor, in which the vibration component becomes largest is different from the normal direction. Therefore, the vibration component with which the attachment surface easily causes a noise can be prevented from transmitting to the attachment surface.

As a result, it is able to provide the attachment structure for a compressor with which the occurrence of noise occurred by a vibration of the attachment surface of the attachment target member can be suppressed.

The attachment surface is a surface to which a compressor is attached, in other words, a surface in which noise may be caused by a vibration of the compressor. Therefore, the attachment surface is not limited to be a flat surface and may be a curved surface or a bent surface. For example, the attachment surface may be a curved surface that is formed to have an arc shape when viewed in the axial direction of the central axis.

Furthermore, in a case where a locally protruding portion or a locally recessed portion is formed in an attachment part for a compressor, the attachment surface may be a surface excluding such a portion. In addition, in a case where the attachment part has protruding portions and recessed portions when viewed in the axial direction of the central axis, the attachment surface may be a virtual surface in which the protruding portions and the recessed portions are flattened.

According to an attachment structure for a compressor of a second aspect of the present disclosure, when viewed in the axial direction of the central axis, an involute curve that is drawn by a center portion between an inner wall surface and an outer wall surface of the fixed-side tooth is defined as a base involute curve, a center of a base circle of the base involute curve is defined as a central point, a straight line that passes through the central point and a connection point between the base circle and the base involute curve is defined as a first line, a straight line that extends in a normal direction of the attachment surface and passes through the central point is defined as a second line, and an angle between the first line and the second line from the first line to the second line in a scroll direction from a center toward an outer peripheral end of the fixed-side tooth is defined as an attachment angle. The attachment angle may be set to be higher than or equal to 65 degrees and lower than or equal to 155 degrees or to be higher than or equal to 245 degrees and lower than or equal to 355 degrees.

Accordingly, noise occurring in the attachment surface can be reduced effectively regardless of a quantity of turns or a pressure condition of the fixed scroll and the movable scroll.

DESCRIPTION OF EMBODIMENTS

Figure 1:
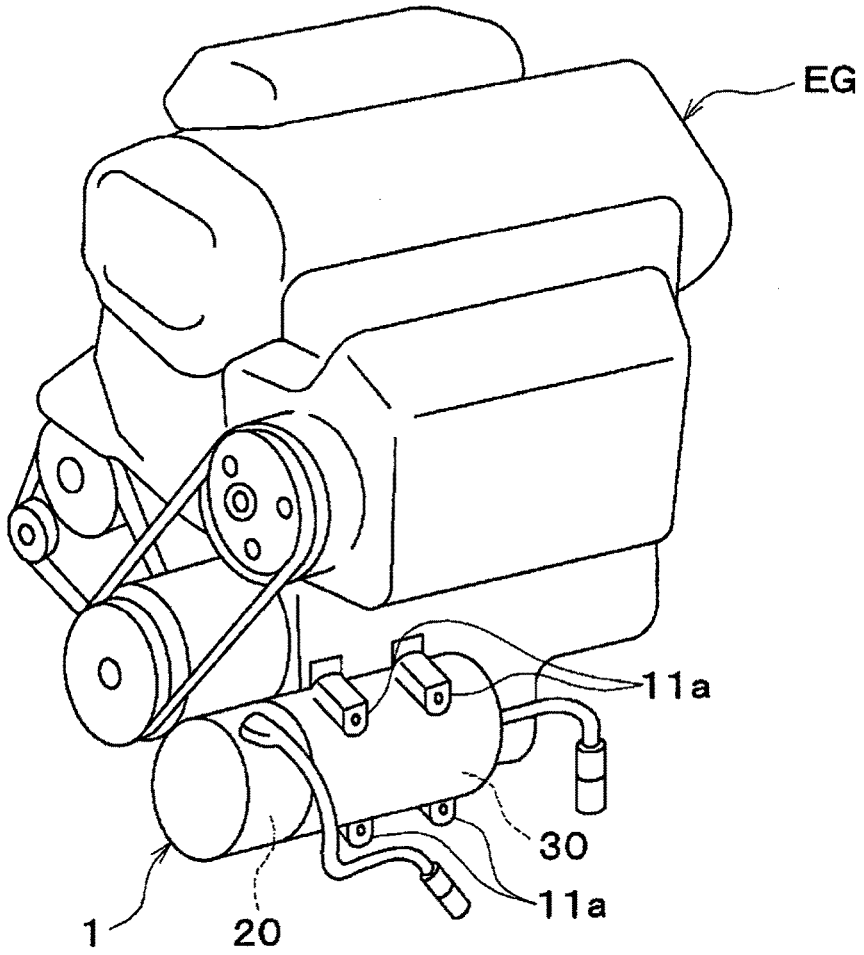
FIG. 1 is an external perspective view illustrating an engine to which a compressor is attached according to a first embodiment.

An embodiment of the present disclosure will be described referring to drawings. According to the present embodiment, an attachment structure for a compressor of the present disclosure is applied in a case where a compressor 1, which compresses a fluid as refrigerant and discharges the fluid in a refrigeration cycle device for a vehicle, is attached to an outer surface (i.e., an attachment surface Ef) of an internal combustion engine (i.e., an engine) that outputs driving force for traveling a vehicle in a hybrid vehicle, as shown in FIG. 1. That is, in the present embodiment, an attachment target member to which the compressor 1 is attached is an engine EG.

According to the present embodiment, the refrigeration cycle device is configured by a radiator, an expansion valve, an evaporator, and the compressor 1 that are connected circular. The radiator makes a high-temperature refrigerant, which is discharged from the compressor 1, radiate heat. The expansion valve reduces a pressure of refrigerant flowing out of the radiator. The evaporator evaporates a low-pressure refrigerant of which pressure is reduced in the expansion valve. The refrigeration cycle device, in a vehicle air conditioner, adjusts a temperature of air that is to be blown into a vehicle compartment.

The hybrid vehicle is a vehicle that gains driving force for traveling from both the engine EG and an electric motor for traveling. In the hybrid vehicle, the engine EG is started or stopped depending on a traveling load of the vehicle to switch traveling conditions, for example, between a traveling condition in which driving force is gained from both the engine EG and the electric motor for traveling and a traveling condition in which driving force is gained from only the electric motor for traveling while the engine is being stopped. Accordingly, a fuel efficiency of the vehicle can be improved.

A configuration of the compressor 1 will be described in detail referring to FIG. 2 and FIG. 3. The compressor 1 has a housing 10 provided with a fixing portion 11*a* to be attached to the engine EG. The housing 10 therein houses a scroll type compression mechanism 20, an electric motor 30, and a shaft 25. That is, the compressor 1 is an electric scroll-type compressor. The scroll type compression mechanism 20 will be simply referred to as a compression mechanism 20 hereafter. The electric motor 30 revolves the compression mechanism 20. The shaft 25 is a drive shaft that transmits a rotational driving force from the electric motor 30 to the compression mechanism 20.

Figure 2:
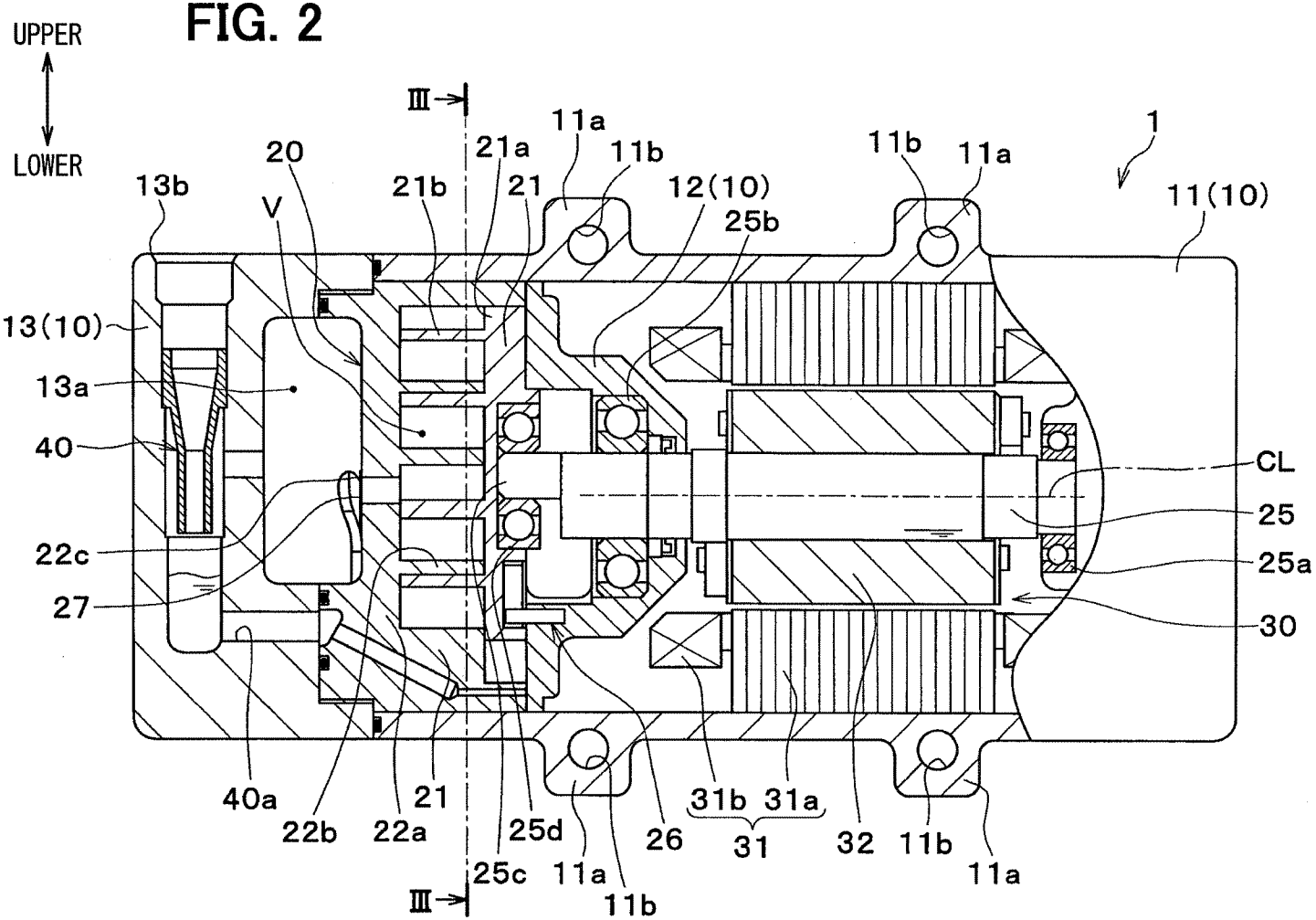
FIG. 2 is an axial sectional view illustrating the compressor according to the first embodiment.
Figure 3:
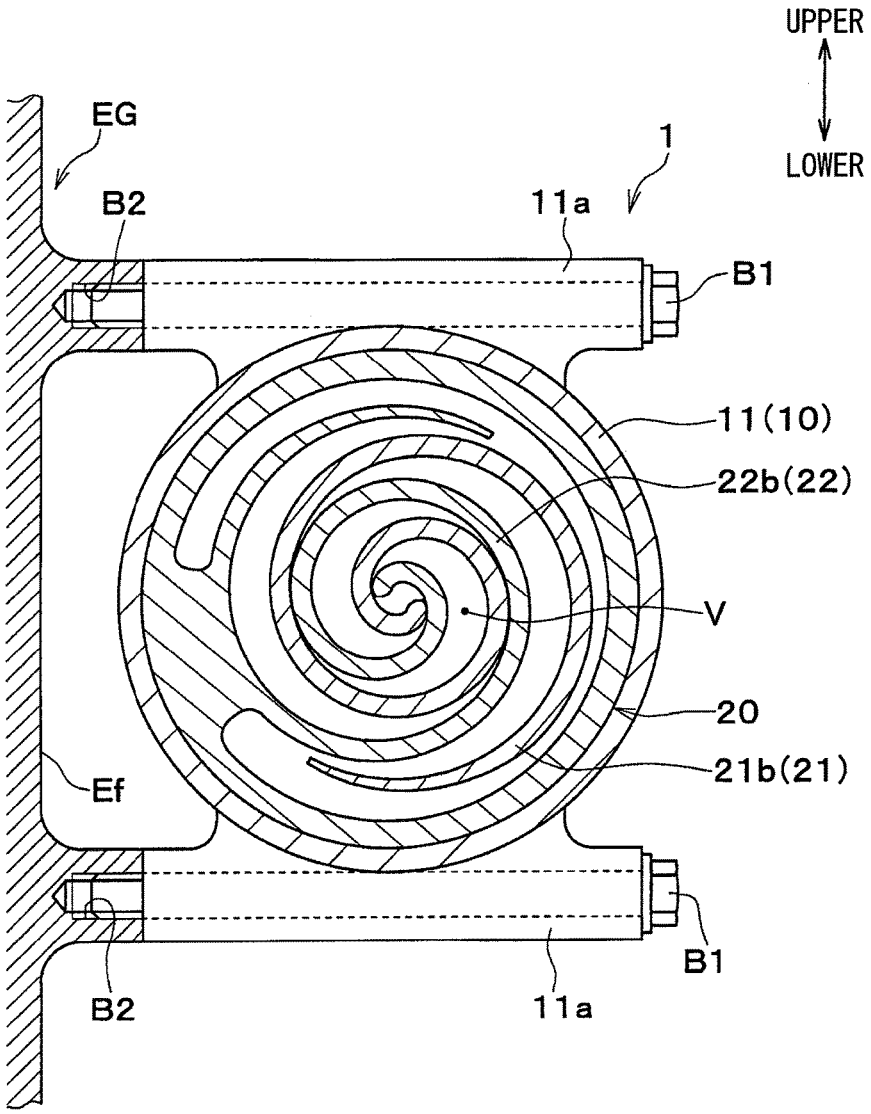
FIG. 3 is a cross sectional view taken along a line III-Ill shown in FIG. 2 on a condition where the compressor is attached to the engine.

Each arrow indicating upper and lower in FIG. 2 and FIG. 3 indicates each direction of upper and lower on a condition where the compressor 1 is attached to the engine EG. Therefore, the compressor 1 of the present embodiment is a horizontal type compressor that is disposed such that a rotational axis of the shaft 25 extends in a horizontal direction, and the compression mechanism 20 and the electric motor 30 are arranged in the horizontal direction.

The housing 10 has a gastight container structure that is configured by coupling metallic members with each other. More specifically, the housing 10 of the present embodiment has a front housing 11, a middle housing 12, and a rear housing 13. The front housing 11 is formed to have a bottomed-cylindrical shape (i.e., a cup shape). The middle housing 12 is arranged inside the front housing 11 and divides an interior space of the housing 10. The rear housing 13 seals an opening side of the front housing 11.

The front housing 11, the middle housing 12, and the rear housing 13 are coupled with each other to be a single member by a method such as press fitting and bolting. Further, the front housing 11, the middle housing 12, and the rear housing 13 are connected to each other through a sealing member configured by an O-ring, a gasket, or the like. Therefore, a leaking of refrigerant from a connecting portion among the front housing 11, the middle housing 12, and the rear housing 13 can be suppressed.

An outer wall surface of the front housing 11 is provided with more than one (e.g., four in the present embodiment) fixing portions 11*a* that are fixed to the engine EG. The fixing portions 11*a* are formed to have a columnar shape that extends from the outer wall surface of the housing 10 to the attachment surface Ef for the compressor 1 provided in the engine EG. Each of the fixing portions 11*a* has a center portion that is provided with a through-hole 11*b* extending in a longitudinal direction of the fixing portion 11*a*.

The compressor 1 is fixed to the engine EG by fastening a bolt B1, which is inserted to the through-hole 11*b*, to a bolt hole B2 provided with the attachment surface Ef. The attachment surface Ef is a surface to which the compressor 1 is attached, in other words, a surface in which noise may occur from a vibration of the compressor 1. Therefore, the attachment surface Ef is not limited to a surface that is in contact with the housing 10 of the compressor 1.

That is, in a case where a locally protruding portion is provided to form the bolt hole B2, the attachment surface Ef is a surface that excludes the portion locally protruding, as shown in FIG. 3. According to the present embodiment, the attachment surface Ef is a flat surface.

A space having generally a columnar shape is formed inside the front housing 11, and the electric motor 30 is disposed in the space as shown in FIG. 2. The electric motor 30 has a stator 31 as a stator and a rotor 32 as a rotor.

The stator 31 is fixed to an inner peripheral side surface of a cylindrical portion of the front housing 11. The stator 31 has a stator core 31*a* made of a magnetic material and a stator coil 31*b* that is wound around the stator core 31*a*. The stator 31 generates a rotating magnetic field for rotating the rotor 32 when electric power is supplied from a controller to the stator coil 31*b*.

The rotor 32 has a permanent magnet and is arranged on an inner side (i.e., an inner peripheral side) of the stator 31. The rotor 32 is formed to have a cylindrical shape that extends in a rotary axis direction. The rotor 32 has a rotary center hole in which a shaft 25 made of metal is fixed by press fitting.

The shaft 25 is formed to have a longer length in an axial direction as compared to the rotor 32. An end portion of the shaft on one side in the axial direction is supported rotatably in a motor side bearing 25*a* that is arranged in a center portion of the front housing 11 on a bottom surface side. On the other hand, the other end side of the shaft in the axial direction (i.e., a side adjacent to the compression mechanism 20) is supported rotatably in a compression mechanism side bearing 25*b* that is arranged generally in a center portion of the middle housing 12 formed to have generally a discoid shape.

Therefore, the rotor 32 and the shaft 25 rotate integrally with each other when electric power is supplied to the stator coil 31*b*, and when the rotating magnetic field is generated. An outer peripheral side surface of the middle housing 12 is press fitted to the inner peripheral side surface of the cylindrical portion of the front housing 11. In other words, the middle housing 12 is press fitted on the inner side of the front housing 11, and the outer peripheral side surface of the middle housing 12 abuts on the inner peripheral side surface of the front housing 11. Accordingly, the middle housing 12 divides the inner space of the housing 10 into a space in which the electric motor 30 is disposed and a space in which the compression mechanism 20 is disposed.

The compression mechanism 20 has a pair of scrolls. Specifically, the pair of scrolls is a movable scroll 21 and a fixed scroll 22. Each of the movable scroll 21 and the fixed scroll 22 has a base portion having a flat plate shape and a tooth that protrudes from the base portion in the axial direction of the shaft 25 and has a scroll shape.

More specifically, the movable scroll 21 has a movable-side base portion 21*a* that has a discoid shape and a movable-side tooth 21*b* that protrudes from the movable-side base portion 21*a* to a side of the fixed scroll 22. The fixed scroll 22 has a fixed-side base portion 22*a* that has a discoid shape and a fixed-side tooth 22*b* that protrudes from the fixed-side base portion 22*a* to a side of the movable scroll 21.

The fixed scroll 22 is fixed to the front housing 11 in a manner that an outer peripheral side surface of the fixed-side base portion 22*a* is press fitted to the inner peripheral side surface of the cylindrical portion of the front housing 11. In other words, the fixed scroll 22 is fitted to the front housing 11 in a manner that the fixed-side base portion 22*a* is press fitted inside the front housing 11. On the other hand, the movable scroll 21 is arranged in a space formed between the middle housing 12 and the fixed scroll 22.

A plate surface of the movable-side base portion 21*a* and a plate surface of the fixed-side base portion 22*a* face each other, and the movable-side tooth 21*b* and the fixed-side tooth 22*b* are engaged with each other. Accordingly, the tooth of one of the movable scroll 21 and the fixed scroll 22 has a tip portion that abuts on the base portion of the other one of the movable scroll 21 and the fixed scroll 22.

As a result, the movable-side tooth 21*b* and the fixed-side tooth 22*b* are in contact with each other at multiple sites, and operation chambers V that have a crescent shape when viewed in the axial direction of the central axis CL of the shaft 25 are formed between the movable-side tooth 21*b* and the fixed-side tooth 22*b*. In FIG. 2 and FIG. 3, only one of the operation chambers V is signed, and signs for other operation chambers are omitted for clarify the drawings.

The above-described end portion of the shaft 25 on the other side in the axial direction (i.e., on the side adjacent to the compression mechanism 20) is provided with an eccentric portion 25*c* that eccentrics with respect to the central axis CL of the shaft 25. A surface of the movable-side base portion 21*a* on a side adjacent to the middle housing 12 has a center portion into which a bearing 25*d* for the eccentric portion that support the eccentric portion 25*c* rotatably is inserted.

A rotation suppressing mechanism 26 that is a pinhole type and suppress a rotation of the movable scroll 21 around the eccentric portion 25*c* is provided between the movable scroll 21 and the middle housing 12. Accordingly, the movable scroll 21 revolves (i.e., pivots) with respect to the fixed scroll 22 to have the central axis CL of the shaft 25 as a revolving center without rotating around the eccentric portion 25*c* when the shaft 25 rotates.

The above-described operation chambers V moves from an outer peripheral side to a center side around the rotational axis as reducing a capacity thereof by revolving. The middle housing 12 of the present embodiment is provided with a suction side communication passage (not shown) through which the operation chambers V, having a maximum capacity by moving to an outermost peripheral side, and a suction port that is formed in the front housing 11 draw refrigerant from outside and communicate with each other.

A discharge hole 22*c* that discharges a refrigerant compressed in the operation chambers V is formed in a center portion of the fixed-side base portion 22*a* of the fixed scroll 22. The discharge hole 22*c* communicates with a discharge chamber 13*a* into which a high-pressure refrigerant compressed in the operation chambers V flows. A lead valve 27 that suppresses a backflow of the refrigerant from the discharge chamber 13*a* to the operation chambers V through the discharge hole 22*c* is arranged in the discharge chamber 13*a*.

The discharge chamber 13*a* is formed by a space between the fixed scroll 22 and the rear housing 13. A refrigerant outlet of the discharge chamber 13*a* communicates with an oil separator 40 that is formed inside the rear housing 13. The oil separator 40 of the present embodiment is a centrifugal type that separates refrigerant and refrigerator oil from each other using centrifugal force.

The refrigerator oil separated by the oil separator is introduced to a sliding portion of the compression mechanism 20 and the electric motor 30 through an oil passage 40*a* formed in the rear housing 13, the fixed scroll 22, and the middle housing 12. On the other hand, a high-pressure refrigerant separated by the oil separator 40 is introduced to a discharge port 13*b* that is provided in the rear housing 13 and discharges the high-pressure refrigerant to an outside of the housing 10 (specifically, to a refrigerant inlet side of the radiator).

Figure 4:
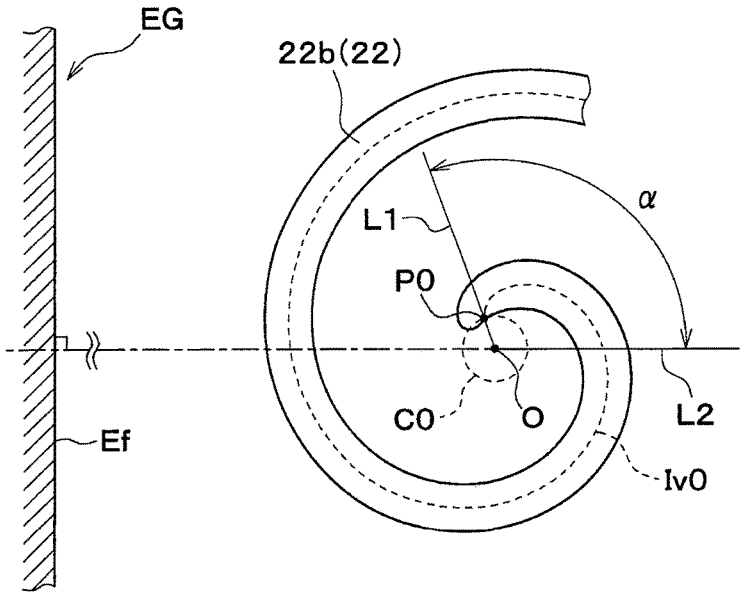
FIG. 4 is an explanatory view for explaining an attachment angle of the compressor according to the first embodiment.

An attachment structure for attaching the compressor 1 to the attachment surface Ef of the engine EG according to the present embodiment will be described hereafter referring to FIG. 4. According to the present embodiment, the central axis CL of the shaft 25 is parallel with the attachment surface Ef. An attachment angle $\alpha$ of the compressor 1 shown in FIG. 4 is set to satisfy the following expression F1 and expression F2.

$$65° \leq \alpha \leq 155° \quad (F1)$$

$$245° \leq \alpha \leq 335° \quad (F2)$$

More specifically, according to the present embodiment, the attachment angle α of the compressor 1 is set to be about 110°. The attachment angle α is defined as follows according to the present embodiment.

When viewed in the axial direction of the central axis CL of the shaft 25, an involute curve that is drawn by a center portion between an inner wall surface and an outer wall surface of the fixed-side tooth 22*b* is defined as a base involute curve Iv0, a base circle of the base involute curve Iv0 is defined as a base circle C0, a center of the base circle C0 is defined as a central point O, a straight line that passes through the central point O and a connection point P0 between the base circle C0 and the base involute curve Iv0 is defined as a first line L1, a straight line that extends in a normal direction of the attachment surface Ef and passes through the central point O of the base circle C0 is defined as a second line L2. Then, as shown in FIG. 4, the attachment angle α is defined as an angle between the first line L1 and the second line L2 from the first line L1 to the second line L2 in a scroll direction from a center side toward an outer peripheral side of the fixed-side tooth 22*b*.

An operation of the compressor 1 of the present embodiment with the above-described structure will be described. The movable scroll 21 revolves with respect to the fixed scroll 22 when the rotor 32 and the shaft 25 rotate by electric power supplied to the electric motor 30. Accordingly, the operation chambers V of the compression mechanism 20 move from the outer peripheral side to the center side around the rotational axis while reducing the capacity thereof.

At the time, the suction port communicates with the operation chambers V having the maximum capacity by moving to the outermost peripheral side, and a low-pressure refrigerant is drawn from outside to the operation chambers V. The refrigerant in the operation chambers V is compressed by the operation chambers V varying while reducing the capacity thereof.

The lead valve 27 is opened when the operation chambers V moves to the center side and communicates with the discharge hole 22*c*, and when a pressure of the refrigerant in the operation chambers V exceeds a valve opening pressure, thereby a high-pressure refrigerant in the operation chambers V flows into the discharge chamber 13*a* through the discharge hole 22*c*. The high-pressure refrigerant flowing out of the discharge chamber 13*a* is discharged from the discharge port 13*b* after the refrigerator oil is separated in the oil separator 40.

As described above, according to a scroll type compressor as the compressor 1 of the present embodiment, the pressure of refrigerant in the operation chambers V increases as moving the operation chambers V from the outer peripheral side to the center side. In this occasion, a driving torque required to the electric motor 30 increases as increasing the pressure of refrigerant in the operation chambers V.

The driving torque required to the electric motor 30 varies periodically since the operation chambers V varies periodically in conjunction with a rotation of the shaft 25. A periodical change of the driving torque results a vibration of an entirety of the compressor 1.

Further, in the scroll type compressor, vibration components in the radial direction become uneven when viewed in the axial direction of the central axis CL, and the vibration components may easily have distribution in the radial direction, since the operation chambers V moves around the rotational axis.

Therefore, the vibration as a whole of the compressor 1 transmits to the attachment surface Ef, for example, when the compressor 1 is operated while the engine EG is stopped. A large noise may be caused when the attachment surface Ef functions as a diaphragm. In addition, according to studies by inventors of the present disclosure, a vibration component that makes the attachment surface Ef easily generate noise is a vibration component in a direction perpendicular to the attachment surface Ef. In other words, it is found that a vibration component in the radial direction that contributes most to noise caused in the attachment surface Ef is a vibration component that transmits in the direction perpendicular to the attachment surface Ef. Based on the findings, it is found that the noise caused in the attachment surface Ef can be suppressed by disposing the compressor 1 such that one direction of directions in which the compressor 1 vibrates when being operated, in which the compressor 1 vibrates largest (i.e., a vibration direction in which the vibration component becomes largest), does not coincide with the normal direction of the attachment surface Ef.

Then, according to the present embodiment, the compressor 1 is attached to the attachment surface Ef of the engine EG at the attachment angle α that is set to satisfy the above expression F1 and expression F2 (specifically, set to be about) 110°. Therefore, the vibration direction which is included in the radial direction of the compressor 1 and in which the vibration component becomes largest can be different from the normal direction of the attachment surface Ef (corresponding to the direction perpendicular to the attachment surface Ef).

In other words, the vibration direction, which is included in the radial direction of the compressor 1 and in which the vibration component becomes largest, can be different from (i.e., not parallel with) the normal direction of the attachment surface Ef. As a result, according to the attachment structure for the compressor 1 of the present embodiment, a transmission of the vibration component, which easily causes noise in the attachment surface Ef, from the compressor 1 to the attachment surface Ef can be suppressed, and the noise caused by the vibration of the attachment surface Ef can be suppressed.

Figure 5:
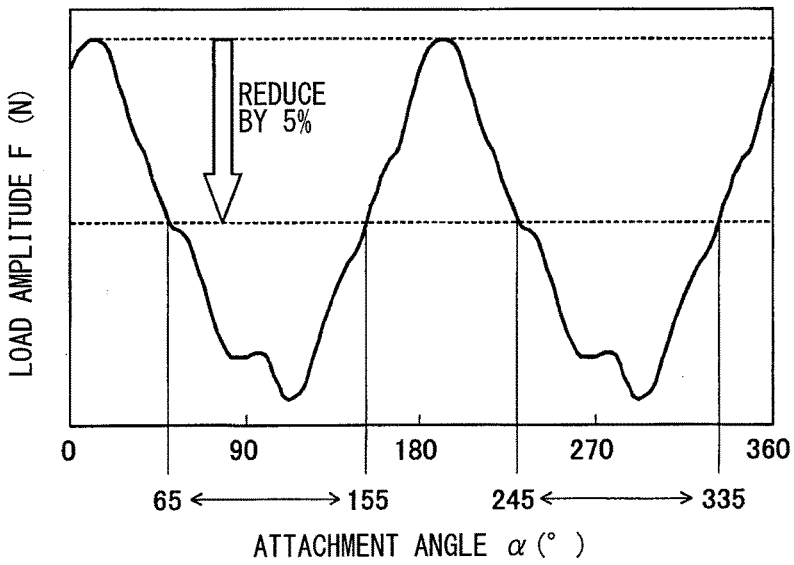
FIG. 5 is a graph showing a relation between the attachment angle of the compressor and a load amplitude according to the first embodiment.

More specifically, according to the attachment structure of the present embodiment, a load amplitude F of the vibration component in the direction perpendicular to the attachment surface Ef varies as shown in FIG. 5 when the attachment angle α is changed. As shown in FIG. 5, the load amplitude F becomes largest when the attachment angle α is about 20° or 200° since the vibration direction (i.e., a direction in which the compressor 1 vibrates largest), which is included in the radial direction of the compressor 1 and in which the vibration component becomes largest, coincides with the normal direction of the attachment surface Ef.

In contrast, the load amplitude F can be reduced by more than or equal to 5% by setting the attachment angle α to satisfy the above expression F1 or expression F2 as the present embodiment. That is, noise caused by the vibration of the attachment surface Ef can be suppressed.

The attachment angle α may be set to satisfy the following expression F3 or expression F4 to gain an effective noise reducing effect.

$$85° \leq \alpha \leq 135° \quad (F3)$$

$$265° \leq \alpha \leq 335° \quad (F4)$$

Further, an attachment error of the attachment angle α may be within about 10% with respect to a target value to gain the effective noise reducing effect. For example, according to the present embodiment, the attachment angle α is preferably set to be a target value 110°±10°. As obvious from FIG. 5, it is substantially the same to set 100° as the target value and to set 290° as the target value. Therefore, the attachment angle α is preferably set to be 290°±10° when 290° is set as the target value.

As described above, in the scroll type compressor, the entirety of the compressor 1 vibrates by increasing a pressure of the refrigerant in the operation chambers V that moves to the center side, thereby less affected by a pressure of the refrigerant in the operation chambers V that moves to the outer peripheral side.

In contrast, according to the attachment structure for the compressor 1 of the present embodiment, the attachment angle α is set based on a shape of the center side of the fixed scroll 22. Accordingly, noise caused in the attachment surface Ef can be effectively reduced regardless of a quantity of turns and a pressure condition of the fixed scroll 22 and the movable scroll 21. The pressure condition is, for example, a pressure difference between a refrigerant pressure on a side adjacent to the discharge port 13*b* and a refrigerant pressure on a side adjacent to the suction port.

The compressor 1 of the present embodiment is an electric compressor and is mounted in a hybrid vehicle. Accordingly, the compressor 1 may be operated while the engine EG is stopped. A noise caused by the compressor 1 may be annoying for a passenger when the compressor 1 is operated since an engine noise is not caused when the engine EG is stopped. Therefore, the attachment structure for a compressor according to the present embodiment is extremely effective to suppress the noise when an electric compressor is used as the compressor 1.

Moreover, according to the present embodiment, the compressor 1 is fixed to the engine EG by bolting or the like on a condition of being directly in contact with each other without interposing a cushion member such as rubber. By such fixing structure, vibration of the compressor 1 easily transmits to a side of the attachment surface Ef. Therefore, the attachment structure for a compressor according to the present embodiment is extremely effective to suppress the noise.

Other Modifications

It should be understood that the present disclosure is not limited to the above-described embodiments and intended to cover various modification within a scope of the present disclosure as described hereafter.

(1) According to the above-described embodiment, the attachment structure for a compressor of the present disclosure is applied to a case where the compressor 1 for the refrigeration cycle device is attached to the attachment surface Ef of the engine EG. However, the present disclosure is not limited to apply only to that case.

For example, the compressor 1 is not limited to be used for a refrigeration cycle device. Further, the attachment target member is not limited to the engine EG and may be, for example, an electric motor for traveling that outputs driving force for traveling a vehicle in a hybrid vehicle. In addition, it is not limited to be used for a vehicle and may be a specified attachment member that is set depending on a usage.

(2) According to the above-described embodiment, the electric compressor is attached to the attachment target member (i.e., the engine EG). However, the compressor is not limited to be electric type. For example, the compressor may be an engine driven compressor that gains driving force from an engine.

(3) According to the above-described embodiment, the attachment surface Ef is a flat surface. However, the attachment surface Ef is a surface to which the compressor 1 is attached and is a surface that causes noise by a vibration of the compressor 1. Therefore, the attachment surface Ef is not limited to be a flat surface and may be a curved surface or a bent surface.

Figure 6:
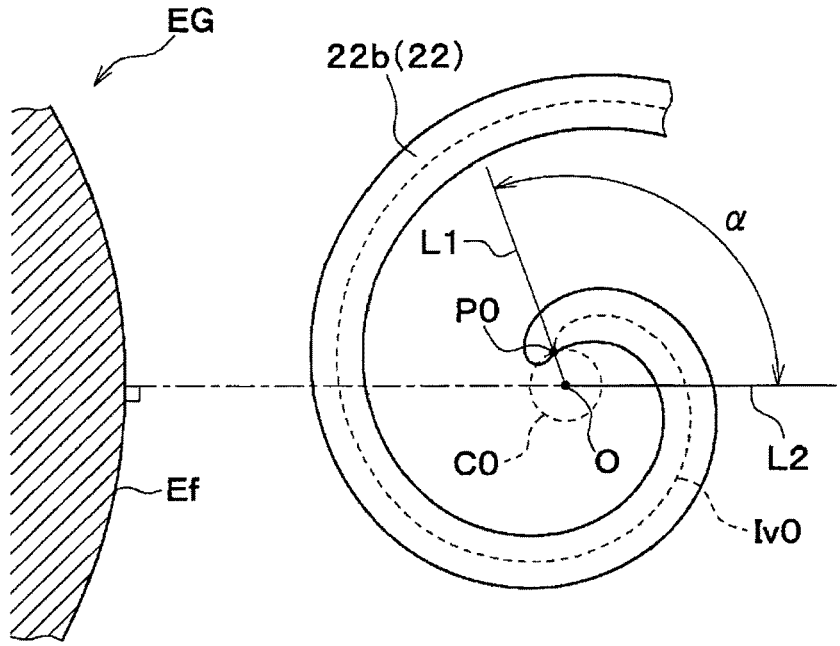
FIG. 6 is an explanatory view for explaining an attachment surface according to another embodiment.

For example, as shown in FIG. 6, the attachment surface Ef may be a curved surface that has an arc shape when viewed in the axial direction of the central axis CL. In this case, a direction in which the second line L2 extends coincides with the normal direction of the attachment surface Ef as shown in FIG. 6. The normal direction of the attachment surface Ef corresponds to the direction perpendicular to the attachment surface Ef. In other words, the direction in which the second line L2 extends is defined as a normal direction of a flat surface that passes through a point in the curved attachment surface closest to the compressor 1.

Figure 7:
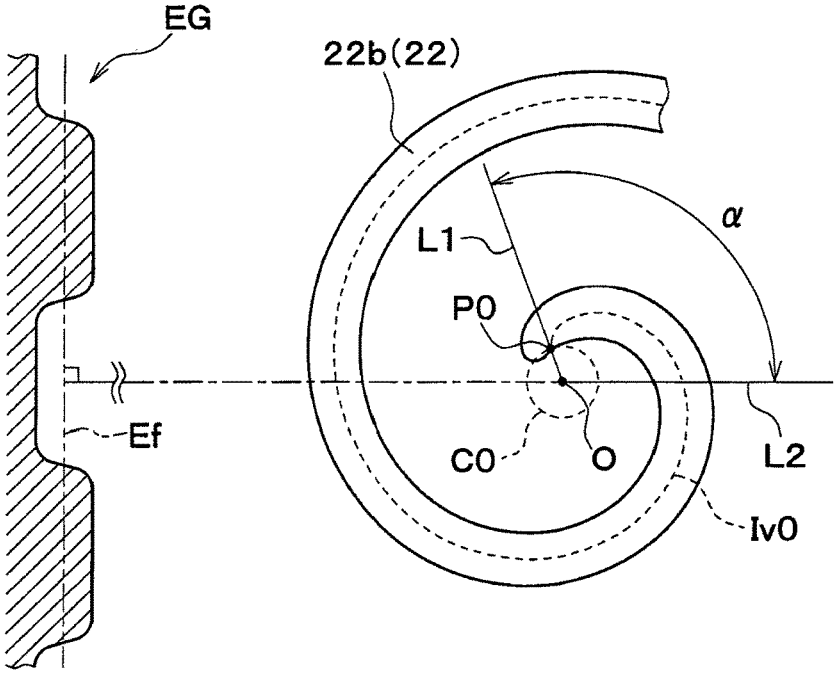
FIG. 7 is an explanatory view for explaining another attachment surface according to another embodiment.

Further, as shown in FIG. 7, the attachment surface Ef may be a virtual surface (i.e., a surface shown by a double-dashed chain line in FIG. 7) that is assumed to cause noise the same as a flat surface in which asperity is flattened in a case where an actual attachment surface has asperity when viewed in the axial direction of the central axis CL. In this case, the direction in which the second line L2 extends coincides with the normal direction of the attachment surface Ef as shown in FIG. 7.

FIG. 6 and FIG. 7 are drawings corresponding to FIG. 4, and a part that corresponds to a matter described in the above-described embodiment may be assigned with the same reference number.

What is claimed is:

1. A compressor in combination with an attachment target member having an attachment surface, wherein the compressor is a scroll type compressor, and compresses and discharges a fluid, the compressor comprising:

a housing that is fixed to the attachment surface of the attachment target member;

a fixed scroll that is fixed inside the housing and has a fixed-side tooth having a scroll shape; and a movable scroll that has a movable-side tooth having a scroll shape and engaging with the fixed-side tooth, the movable scroll that revolves relative to the fixed scroll around a central axis, wherein when viewed along the central axis:

a base involute curve is defined as an involute curve of the fixed-side tooth that extends along a center line between an inner wall surface and an outer wall surface of the fixed-side tooth, and the base involute curve has a base circle with a center;

a connecting point is defined as a point at which the base circle is connected to the base involute curve;

a first line is defined as a line that passes through the connecting point and the center of the base circle;

a second line is defined as a line that extends along a normal direction of the attachment surface and passes through the center of the base circle; and an attachment angle is defined as an angle formed extending from the first line to the second line in an extending direction of the base involute curve from the connecting point, wherein the central axis is parallel with the attachment surface; and the attachment angle is $65° \leq \alpha \leq 155°$ or $245° \leq \alpha \leq 355°$.

2. The compressor according to claim 1, wherein the housing therein houses an electric motor that outputs a rotational driving force for revolving the movable scroll.

3. The compressor according to claim 1, wherein the housing has a fixing portion that is fixed to the attachment surface, the fixing portion has a through-hole to which a bolt is inserted, and the housing is fixed to the attachment surface by fastening the bolt, which is inserted to the through-hole, to a bolt hole provided with the attachment surface.

* * * * *